US005651613A

United States Patent [19]

Mays et al.

[11] Patent Number: 5,651,613

[45] Date of Patent: Jul. 29, 1997

[54] DRUM WITH INTERNAL STATIC MIXER

[75] Inventors: Harry Mays, Merced; Michael Morrison, Stockton, both of Calif.

[73] Assignee: North American Packaging Company, Merced, Calif.

[21] Appl. No.: 501,676

[22] Filed: Jul. 12, 1995

[51] Int. Cl.[6] ..... B01F 9/00

[52] U.S. Cl. ..... 366/227; 99/517; 366/144

[58] Field of Search ..... 366/227, 228, 366/229, 56, 57, 58, 59, 144; 99/517, 536, 348; 68/142; 134/65, 132

[56] References Cited

U.S. PATENT DOCUMENTS

| | | | |
|---|---|---|---|
| 391,520 | 10/1888 | Duekin . | |
| 462,568 | 11/1891 | Mark . | |
| 740,297 | 9/1903 | Moore . | |
| 1,651,816 | 12/1927 | Goldman . | |
| 3,031,807 | 5/1962 | Bylsma et al. | 134/132 |
| 3,259,372 | 7/1966 | Phillips | 366/227 |
| 4,129,389 | 12/1978 | Wakeman et al. | 366/144 |
| 4,176,970 | 12/1979 | Blaetz | 366/280 |
| 4,552,462 | 11/1985 | Schnell | 366/280 |
| 5,104,232 | 4/1992 | Lennox | 366/227 |
| 5,251,979 | 10/1993 | Larsen | 366/279 |
| 5,492,407 | 2/1996 | Gement | 366/228 |

*Primary Examiner*—Robert W. Jenkins

*Attorney, Agent, or Firm*—Townsend and Townsend and Crew LLP

[57] ABSTRACT

A 55 gallon drum is provided with a static mixer that enables internal mixing of product during barrel rotation. Before fastening of at least one of the respective lids, a circular elastic ring insert is place within the barrel. This circular plastic ring insert has a diameter exceeding that of the barrel, has two external protuberances for keying to the cylindrical inside of the barrel at internal ribs, and is cut across the ring so as to interrupt the otherwise endless dimension of the ring. Upon insertion to the barrel, the ring is opened at the cut and disposed in an auger like helix along the inside cylindrical wall of the drum. The two protuberances are keyed to the drum interior of the internal ribs to effectively fasten by friction its helical auger like path on the cylindrical inside wall of the drum. Thereafter, the drum is closed and filled with product. Upon drum rotation, relative motion between the contained product and helical auger like static mixer occurs. Product is moved vertically with respect to the drum side walls towards one end of the drum. Product movement continues to the end of the drum with return product flow to the opposite drum end along the axial dimension. When cooling spraying accompanies such rotation, rapid cooling of the entire drum contents results.

8 Claims, 3 Drawing Sheets

DRUM WITH INTERNAL STATIC MIXER

This invention relates to large metal storage and shipping barrels for food products. More specifically, a static mixer is disclosed for use in combination with a so-called 55 gallon drum. A process including use of the static mixer to rapidly cool hot freshly cooked product inserted within the drum is disclosed.

BACKGROUND OF THE INVENTION

So-called "55 gallon" drums are used for both storage and transport of numerous liquid or semi-liquid products. Unfortunately, products once placed in such drums undergo little mixing. Some discussion of the construction of "55 gallon" drums can explain this inherent lack of mixing.

A closed head 55 gallon drum consists of a steel cylinder provided with two cylindrical ribs formed by internally cold working the steel cylinder. Circular bottom and top steel lids close both ends of the cylinder with the cylinder sides and circular periphery of the lids being mechanically seamed into a fluid tight joint to close the cylinder. In the case of the closed head drum intended for this application, the top circular lid is provided with a 4½" diameter central opening or bung. It is through this opening or bung that the barrel is filled with product. After filling the drum is sealed by inserting a cap in the opening and swaging it in.

So-called "open head" 55 gallon drums are known. These drums have a head which is approximately the same diameter as the barrel itself. In this case, one end of the barrel defines a seat for a removable head having the same dimension as the end of the barrel. Typically, when the barrel is filled with product, the head is placed and secured typically with a "bolt ring"—a removable ring which extends around the barrel to protect the removable head at its seat from disruption during storage and transport.

When a barrel is moved, it is either lifted—usually on a pallet with other drums, or rolled. Lifting effects little mixing. Likewise, rolling effects little mixing. When the barrel is rolled, the cylindrical side wall of the drum develops some relative movement to the contained product. However, since the drum is symmetrical about an axis though the center of the cylindrical side walls, and closed by two circular end walls, rolling of the drum occurs with little product movement with respect to the cylindrical side wall of the drum. Thus, rolling of the drum produces little more mixing that lifting of the drum.

Standard 55 gallon drums include an actual capacity of 57 gallons. Usually such drums are loaded with 55 gallons of product to be transported and stored. The remaining space in such 55 gallon drums—that is the remaining 2 gallons of capacity—is left as free space. Normally this space is occupied with a gas and defines a "free surface" at the interface between the gas and the rest of the product contained within the 55 gallon drum. This free surface, however, does little to promote internal mixing.

There is a need for mixing in such 55 gallon drums. This need can best be understood by considering the case of a closed head 55 gallon drum immediate after the drum has been loaded with hot, freshly cooked diced tomatoes.

In the case of hot, freshly cooked diced tomatoes, the barrel is filled with a product which needs to be rapidly cooled. Where the product can be immediately cooled, the cooked and cooled diced tomatoes have a firm consistency and desirable food consistency. In the absence of relatively rapid cooling, the diced tomatoes lose their consistency and be come soft and mush like. The diced tomato product loses its food texture and consequently its value.

Current techniques for rapidly cooling the hot diced tomato product include passing the barrel between a series of stations. At each station, the barrel is rotated, rocked, and simultaneously sprayed with water.

This cooling technique is deficient. As the barrel is rotated, rocked and sprayed, product adjacent the cylindrical side wall of the barrel is rapidly cooled and maintains a firm texture. Unfortunately, product in the central axial portion of the barrel is not cooled as rapidly and continues to cook slowly due to the ambient heat in the barrel until the rocking motion works the product to the walls. The continued cooking produces the undesirable mush texture in the tomato product.

SUMMARY OF THE INVENTION

A 55 gallon drum is provided with a static mixer that enables internal mixing of product during barrel rotation. The 55 gallon drum is of standard construction including a cylindrical body with paired internally cold worked ribs for increased cylindrical rigidity. Circular top and bottom lids close the cylinder at cold rolled fluid tight seams. Before fastening of at least one of the respective lids, a circular elastic ring insert is place within the barrel. This circular plastic ring insert has a diameter exceeding that of the barrel, has two external protuberances for keying to the cylindrical inside of the barrel at internal ribs, and is cut across the ring so as to interrupt the otherwise endless dimension of the ring. Upon insertion to the barrel, the ring is opened at the cut and disposed in an auger like helix along the inside cylindrical wall of the drum. The two protuberances are keyed to the drum interior of the internal ribs to effectively fasten by friction its helical auger like path on the cylindrical inside wall of the drum. Thereafter, the drum is closed, filled with product, sealed with the cap, conveyed to the cooler, and "downended" into a horizontal position for cooling. Upon drum rotation, relative motion between the contained product and helical auger like static mixer occurs. Product is moved vertically with respect to the drum side walls towards one end of the drum. Product movement continues to the end of the drum with return product flow to the opposite drum end along the axial dimension. When cooling spraying accompanies such rotation, rapid cooling of the entire drum contents results.

DESCRIPTION OF THE PREFERRED EMBODIMENT

Figure 2:
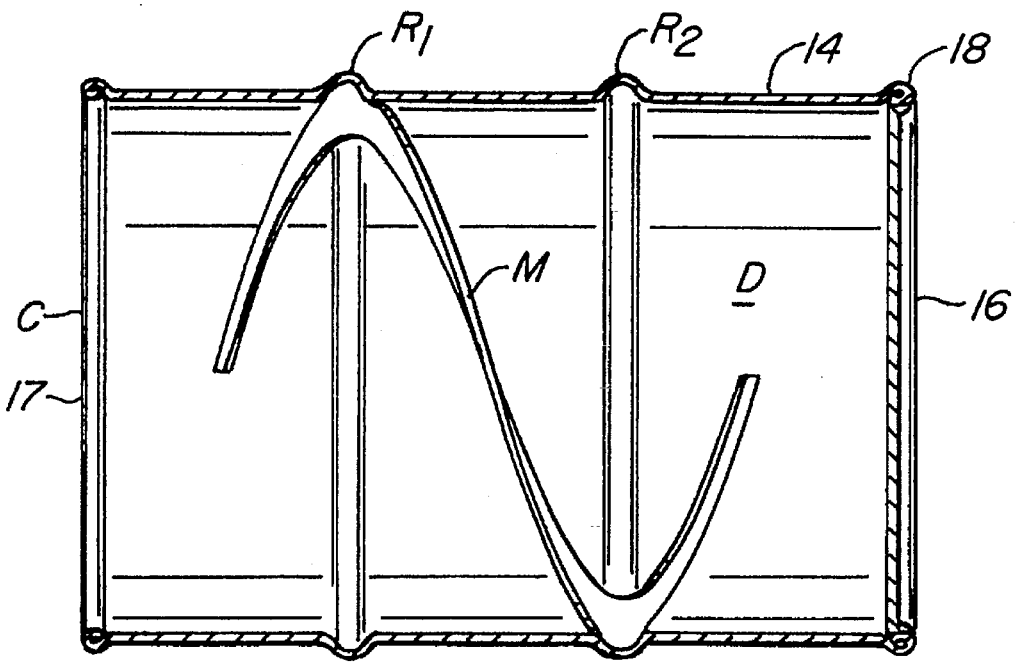
FIG. 2 is an elevation of a 55 gallon drum with the helix ring inserted with an end view illustrating the opening for filling.
Figure 3:
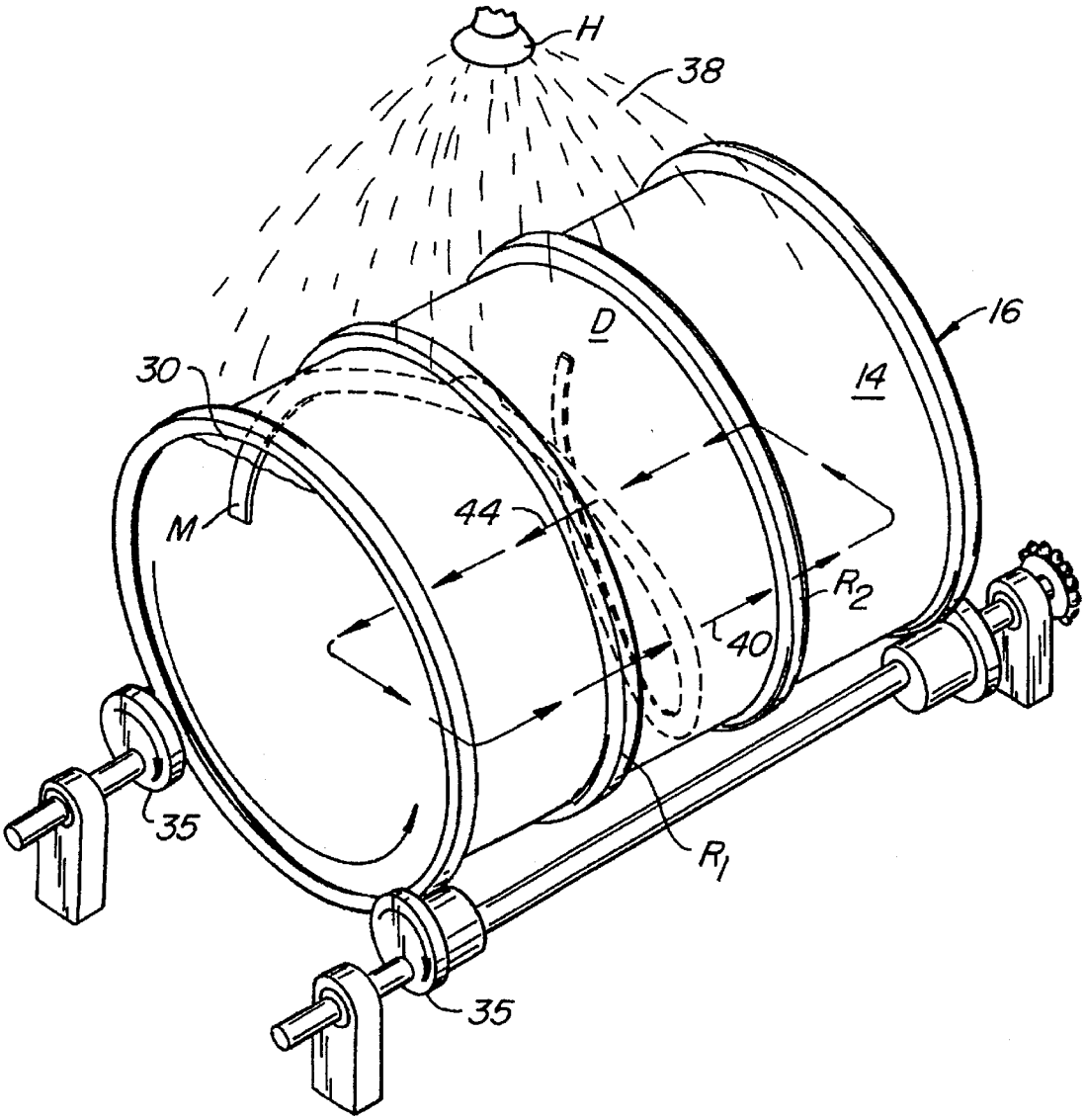
FIG. 3 is a partial perspective view of a 55 gallon drum having cooling water spray and horizontal rotation about the axis of the steel cylindrical side wall of the barrel illustrating with broken arrow lines the flow path of contained product within the barrel during barrel rotation.

Referring to FIGS. 2 and 3, the preferred embodiment of this invention is illustrated with respect to an open head drum D. A brief discussion of the construction of drum D is in order.

Drum D includes cylindrical side wall 14 with internal cold rolled ribs $R_1$–$R_2$. As will hereafter be seen, these respective ribs $R_1$–$R_2$ form the points where anchoring of static mixer M occurs. At one end, drum D includes circular end 16 connected to cylindrical side wall 14 at seamed joint 18. At the opposite end, circular end 17 is connected to sidewall 14 at seamed joint. Removable cap C fits over the end opening and closes drum D when the barrel is filled. Before the ends are seamed into the sidewall, it is necessary to insert static mixer M. Understanding this much, static mixer M can now be described.

Figure 1:
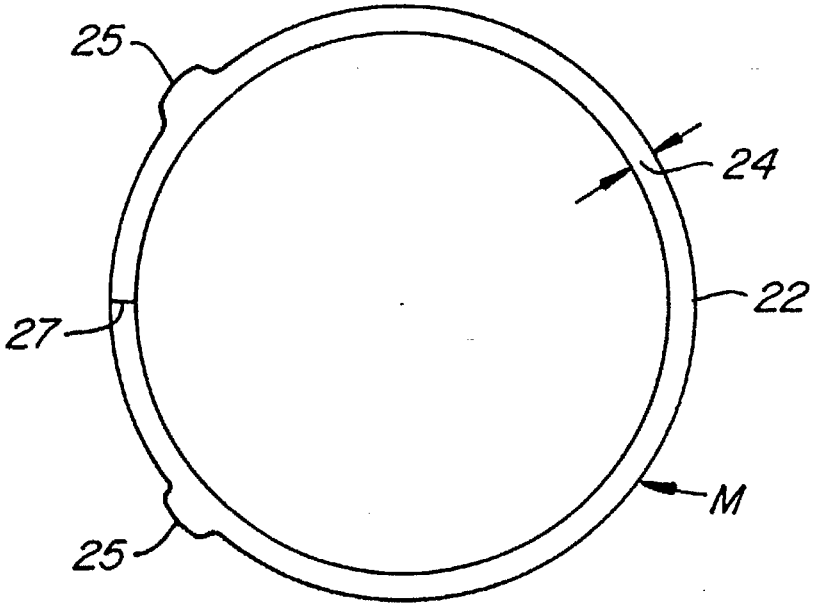
FIG. 1 is a plan view of the helix ring of this invention illustrating the ring, the pair protuberances for keying to the internal cold rolled ribs of a 55 gallon barrel, and the parting line cut for enabling the helical insertion of the ring to the barrel.

Referring to FIG. 1, static mixer M is illustrated. Typically static mixer M is formed in an injection mold from plastic resin in the shape of ring 22. Ring 22 may be planar or, alternatively, have a flange on the outer diameter. Ring 22 has depth 24 of sufficient dimension to effect mixing of the particular product desired to be placed within drum D. Some exemplary dimension include a two inch depth 24 to ring 22 for a diced tomato product placed within open head drum D.

Ring 22 has a diameter exceeding the 22½" inside diameter of drum D. Preferably, the diameter of ring 22 is about 24 inches. As will be seen, this expanded diameter enables ring 22 to be disposed in a helical path when it is placed interior of drum D.

Ring 22 has rib protrusions 25 on opposite sides of cut 27. Cut 27 allows the ring to be opened. Rib protrusions 25 enable static mixer M to key to ribs $R_1$–$R_2$. By keying one rib protrusions 25 in ribs $R_1$ and one rib protrusions 25 in rib $R_2$, static mixer M can be opened and disposed in a helical path along the interior of cylindrical side wall 14 of drum D.

Having set forth the general description of drum D and static mixer M, attention can now be turned to FIG. 3. In FIG. 3, drum D is to be understood loaded with diced tomato product. In the normal case, so-called 55 gallon drum D will be loaded with 55 gallons of diced tomato product. The interior of drum D defines a volume of 57 gallons. Accordingly, there exists free space 30 at the top of drum D.

In the case of hot diced tomatoes, drum D is loaded with product and then sent to a rotation station, such as that schematically illustrated in FIG. 3. Barrel rotators 35 cause drum D to rotate. During such rotation, free space 30 remains roughly at the top of drum D.

It is required that drum D be subjected to spray during rotation. Accordingly, spray head H releases cooling water 38 on the exterior of drum D during rotation on barrel rotators 35. Understanding the effect of such rotation in the presence of static mixer M is instructive.

It will be understood that with respect to the prior art, barrel rotators 35 enabled the exterior surface of product to be cooled rapidly. The problem was that product in and along the central axis of the barrel did not undergo rapid cooling. Static mixer M obviates this problem.

When drum D rotates on barrel rotators 35, relative movement between product contained in drum D and cylindrical side wall 14 occurs. Static mixer M takes advantage of this relative movement. Specifically, static mixer M acts like an internal auger flight and serves to displace product along the cylindrical side wall. Specifically, product is displaced along path 40 to one end of drum D.

On reaching the end of drum D, the product is displaced along the inside of circular end 16. Thereafter, flow occurs centrally and axially of drum D along axial path 44. This flow continues until contact with removable barrel cap C occurs. Thereafter, flow occurs along the inside surface of removable barrel cap C with return to cylindrical side wall 14. Circulation of the central cylindrical portion of the stored product occurs to the interior cylindrical side walls of drum D. This enables thorough cooling of all product interior of drum D to occur.

Figure 4:
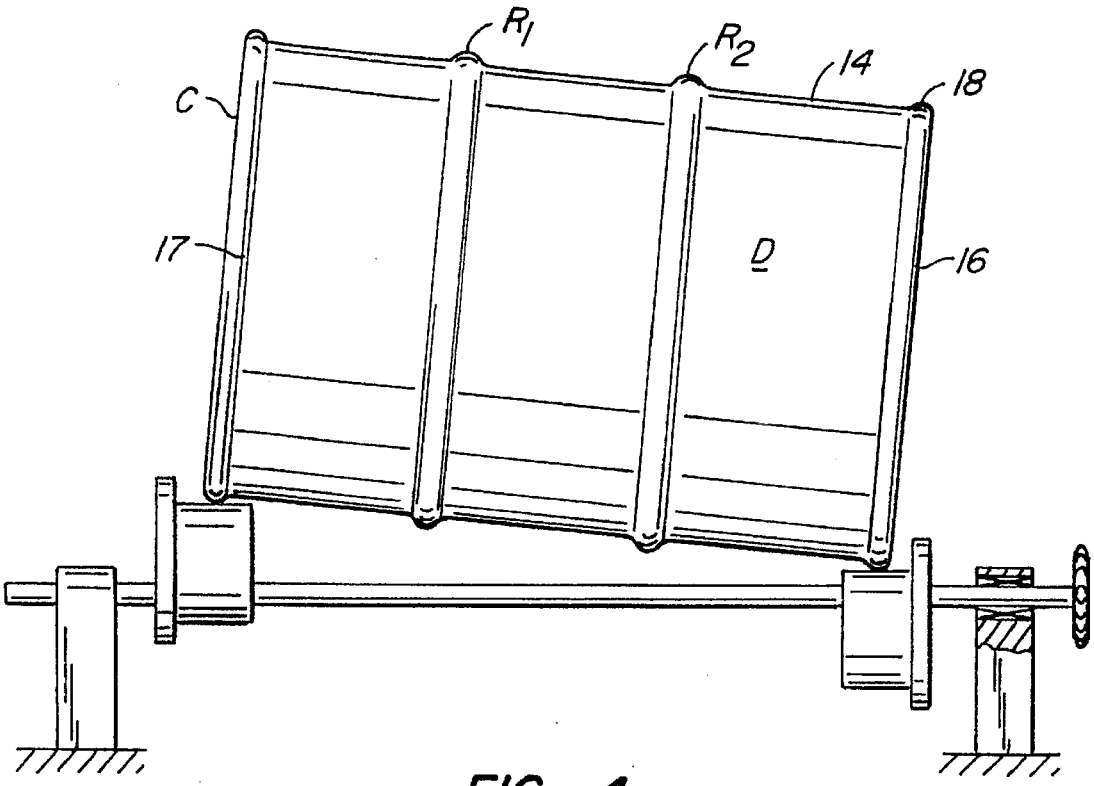
FIG. 4 is a side elevation of a drum with a static mixer, the mixer being held in place by compression of a helical member between the drum ends; and, FIG. 5 is a side elevation section similar to FIG. 2 illustrating a so-called 55 gallon drum with a static mixer compressed between the respective ends of the drum.
Figure 5:
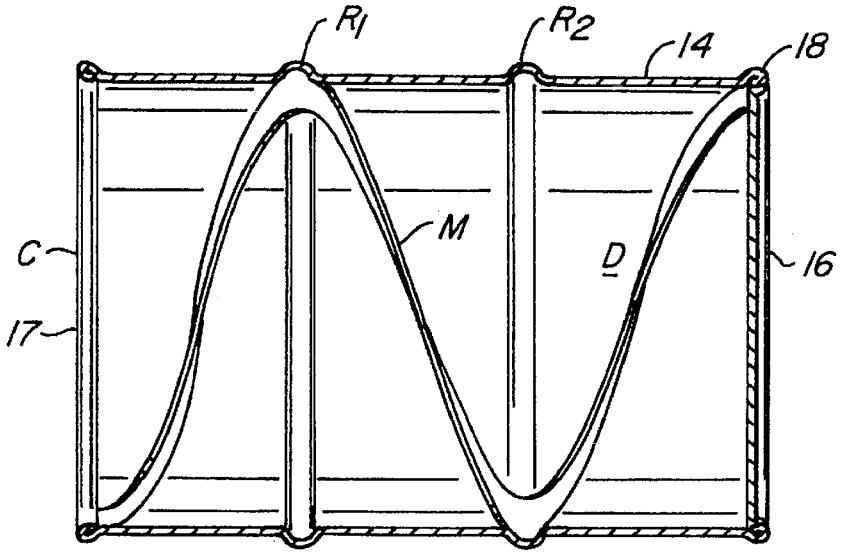

With attention to FIG. 4, it will be understood that static mixed M' can be mounted within drum D by many differing expedients. For example, fastening by welding is contemplated. In the case of FIG. 5, static mixer M' is given a dimension which exceeds the length between circular ends 16, 17. When the ends are placed, static mixer M' is compressed. Such compression secures static mixer M' either at respective ends 16 and 17, or at the inside walls of drum D, or both.

We have illustrated the preferred placement of static mixer M with a closed head barrel. It will be understood that use with a so-called "open head" barrel can likewise occur. Further, use for only cooling is not required. Many barrel transported products can utilize thorough mixing during storage and transport. By the expedient of rotating drum D containing such product, mixing can occur.

We illustrate our invention with a 55 gallon steel drum. Restriction to such a specific kind of container is not required. While we preferred to utilize our invention within such a barrel, the invention can be practiced with other types of containers.

What is claimed is:

1. In combination with a drum having:

cylindrical side walls;

two circular ends;

the improvement comprising:

a static mixer disposed interior of the drum adjacent the cylindrical sidewalls of the drum;

the drum includes paired internally formed ribs; and, the static mixer includes means for fastening to the paired internally formed ribs.

2. The combination of claim 1 and wherein:

the static mixer is held in place by compressing the static mixer between the two circular ends of the drum.

3. The combination of claim 1 and wherein:

the means for fastening to the paired internally formed ribs includes paired protuberances for fictionally keying to the internally formed ribs.

4. A drum with internal static mixer comprising in combination:

cylindrical side walls symmetric about an axis having a first diameter;

paired internally formed ribs in the cylindrical side walls;

two circular ends having sufficient diameter to close the ends of the cylindrical side walls;

a static mixer formed from planar and elastic material having a second diameter greater than the first diameter, the static mixer including at least paired external protuberances for keying to the internally formed ribs in the cylindrical side wall;

said static mixer compressed and placed interior of the cylindrical side wall of the drum with the protuberances keyed to the internal ribs to maintain the static mixer fixed with respect to the drum.

5. A drum with internal static mixer according to claim 4 and wherein:

the static mixer formed from planar and elastic material in the shape of a ring.

6. A drum with internal static mixer according to claim 5 and wherein:

the ring is disposed adjacent the internal cylindrical side walls along a helical auger like path.

7. A process of mixing the contents of a drum comprising the steps of:

providing a cylindrical drum;

placing an internal static mixer within the drum with the mixer disposed in a helical auger like path on the interior cylindrical walls of the drum;

filling the drum with product;

rotating the drum to produce relative motion between the drum and contained product whereby the static mixer has relative motion relative to the contained product to mix the product within the drum; and, spraying the drum to rapidly cool the contents of the drum.

8. A process of mixing the contents of a drum according to claim 7 and comprising the further steps of:

filling the drum with product to less than the full capacity of the drum.

* * * * *